US005341954A

United States Patent [19]

Smith

[11] Patent Number: 5,341,954

[45] Date of Patent: Aug. 30, 1994

[54] PRODUCT DISPENSER FOR A VENDING MACHINE

[76] Inventor: Bruce A. Smith, P.O. Box 28, Bonaparte, Iowa 52620

[21] Appl. No.: 30,915

[22] Filed: Mar. 15, 1993

[51] Int. Cl.[5] ..... G07F 11/00

[52] U.S. Cl. ..... 221/85

[58] Field of Search ..... 221/84, 85, 82, 76, 221/195, 155; 198/690.2, 699

[56] References Cited

U.S. PATENT DOCUMENTS

| | | | |
|---|---|---|---|
| 3,263,857 | 8/1966 | Krakauer et al. | 221/85 |
| 3,335,907 | 8/1967 | Holstein et al. . | |
| 3,759,417 | 9/1973 | Armstrong et al. | 221/85 |
| 3,767,081 | 10/1973 | Wittern . | |
| 3,797,699 | 3/1974 | Wittern et al. . | |
| 3,828,971 | 8/1974 | Offutt et al. . | |
| 3,883,039 | 5/1975 | Wittern et al. . | |
| 3,908,858 | 9/1975 | Wirstlin et al. . | |
| 3,929,255 | 12/1975 | Wittern et al. . | |
| 3,938,699 | 2/1976 | Wittern et al. . | |
| 4,033,442 | 6/1977 | Wirstlin et al. . | |
| 4,108,333 | 8/1978 | Falk et al. | 221/85 X |
| 4,368,829 | 1/1983 | Lotspeich et al. | 221/75 |
| 4,591,070 | 5/1986 | Wirstlin . | |

*Primary Examiner*—David H. Bollinger
*Attorney, Agent, or Firm*—Henderson & Sturm

[57] ABSTRACT

A product dispenser for a vending machine including a conveyor having a continuous belt with flexible transparent dividers spaced at predetermined intervals along the belt. Adjacent transparent dividers form individual product cavities that receive and store a product. The product in the product cavity at the end of the conveyor adjacent to the discharge chute can be identified by viewing it through the transparent front panel of the cabinet and the transparent divider before a product selection is made by the consumer.

20 Claims, 3 Drawing Sheets

PRODUCT DISPENSER FOR A VENDING MACHINE

TECHNICAL FIELD

This invention relates generally to vending machines, and more particularly to an individual product dispenser for a vending machine.

BACKGROUND ART

Typical vending machines utilize a number of individual helical coils each advancing a selected product from storage within the cabinet of the machine to a discharge chute accessible to the consumer. Most items held within the convolutions of each helix can be readily identified by the consumer by viewing it through the front glass panel of the machine. However, some uniquely packaged items such as microwavable meals packaged in a bowl-type container present a special problem. These containers are generally loaded into the helix on edge so that the lid faces the front panel of the machine. Usually the product identification is printed only on a portion of the sidewall of the bowl-type container and is not visible or is only partially visible to the consumer through the glass panel. The consumer therefore is either unsure of or is misled as to the identity of the product that will be dispensed. Those concerned with these and other problems recognize the need for an improved individual product dispenser for a vending machine.

DISCLOSURE OF THE INVENTION

The present invention provides a product dispenser for a vending machine including a conveyor having a continuous belt with flexible transparent dividers spaced at predetermined intervals along the belt. Adjacent transparent dividers form individual product cavities that receive and store a product. The product in the product cavity at the end of the conveyor adjacent to the discharge chute can be identified by viewing it through the transparent front panel of the cabinet and the transparent divider before a product selection is made by the consumer.

An object of the present invention is the provision of an improved product dispenser for a vending machine.

BRIEF DESCRIPTION OF THE DRAWINGS

These and other attributes of the invention will become more clear upon a thorough study of the following description of the best mode for carrying out the invention, particularly when reviewed in conjunction with the drawings, wherein.

BEST MODE FOR CARRYING OUT THE INVENTION

Figure 1:
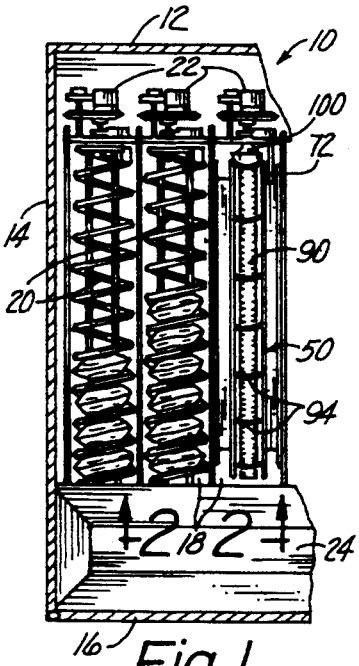
FIG. 1 is a partial top plan view of the interior of a vending machine showing helical product dispensing units mounted in side-by-side relationship with a continuous belt conveyor of the present invention.

Referring now to the drawings, wherein like reference numerals designate identical or corresponding parts throughout the several views, FIG. 1 shows a portion of a cabinet (10) of a vending machine including an upstanding rear wall (12), side walls (14), and a hinged front panel (16) partially formed of transparent material. A number of product dispensing units are mounted in horizontal arrangement on shelves (18) within the cabinet (10). FIG. 1 illustrates a pair of helical product dispensers (20) mounted in side-by-side relationship to the continuous belt conveyor (50) of the present invention. Each of the product dispensing units is driven by an electrical motor (22) and includes a discharge end in communication with the discharge chute (24).

Figure 2:
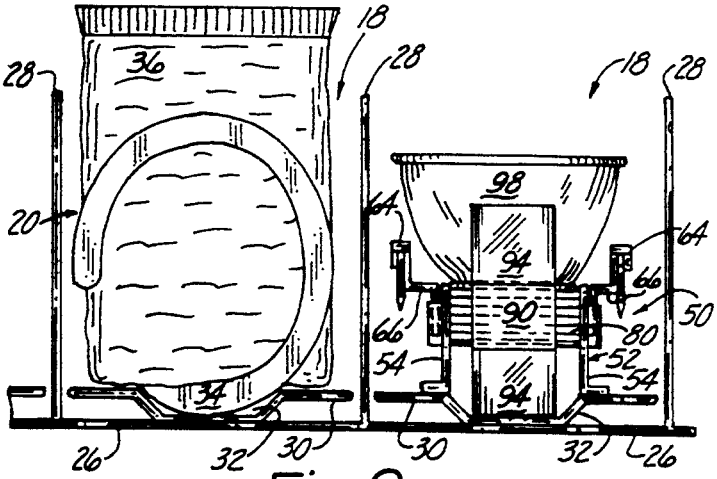
FIG. 2 is an enlarged front elevational view taken along line 2—2 of FIG. 1 showing the terminal ends of adjacent helical and belt conveyors and illustrating a bowl-type container positioned behind the transparent divider of the belt conveyor.

As best shown in FIG. 2, each shelf (18) accommodates a separate dispensing unit and is formed of a base (26), a pair of laterally spaced side walls (28), and a subfloor (30). The subfloor (30) is spaced above the base

(26) except for a centrally formed depression (32). In conventional vending machines the depression (32) is designed to receive a radial width of the helix (34) of the helical dispenser (20) to facilitate movement of the stored product (36) toward the discharge end.

Referring now to FIGS. 2–11, the continuous belt conveyor (50) includes an inverted U-shaped channel frame (52) secured to the shelf subfloor (30) by fasteners (not shown). The frame (52) is most clearly shown in FIGS. 8–11 and includes spaced upstanding legs (54) interconnected by a horizontal floor (56) having longitudinal ridges (58) extending along its upper surface. Elongated slots (60) are formed in the support flange of the legs (54) to receive the fasteners and to allow for fore-and-aft positioning of the frame (52) on the subfloor (30). Openings (62) are formed in opposing legs (54) at the rear and front of the frame to rotatably receive the drive pulley (70) and the idler pulley (80), respectively. Laterally adjustable side rails (64) are pivotally secured to each side of the frame 952) by a pair of S-shaped pivot arms (66) received in sockets (68) which extend out from the legs (54). The drive pulley (70) is rotatably mounted in the openings (62) at the rear of the frame (52) and includes a large, beveled gear (72) mounted coaxially with the drive pulley (70). The idler pulley (80) is rotatably mounted in the openings (62) at the front of the frame (52). Both the drive pulley and the idler pulley (80) have timing grooves (74 and 84) formed on their outer surfaces.

Figure 3:
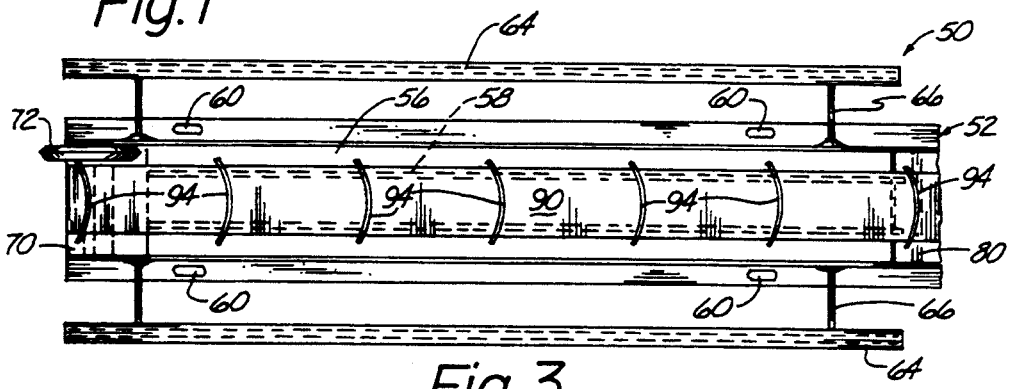
FIG. 3 is a top plan view of the continuous belt conveyor with laterally adjustable side rails.
Figure 4:
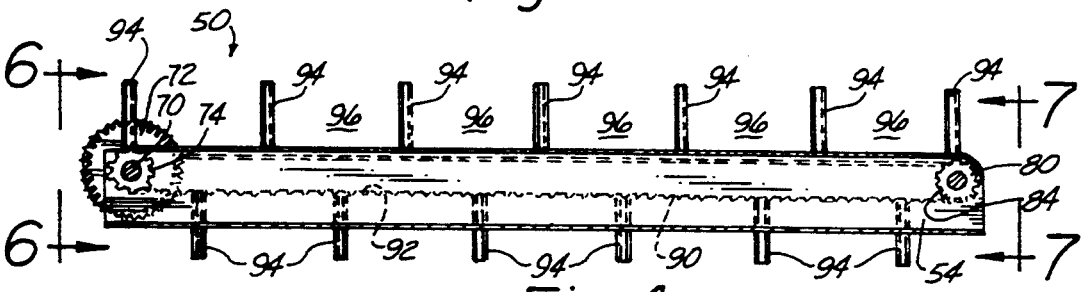
FIG. 4 is a side elevational view of the conveyor with the side rails deleted.
Figure 5:
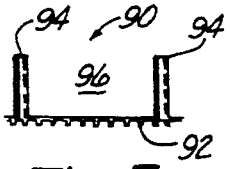
FIG. 5 is a partial side elevational view of the section of the belt, illustrating the timing projections on the underside of the belt.
Figure 6:
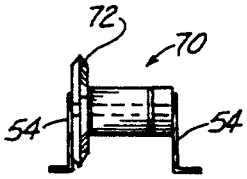
FIG. 6 is a rear elevational view taken along line 6—6 of FIG. 4.
Figure 7:
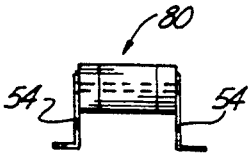
FIG. 7 is a front elevational view taken along line 7—7 of FIG. 4.
Figure 8:
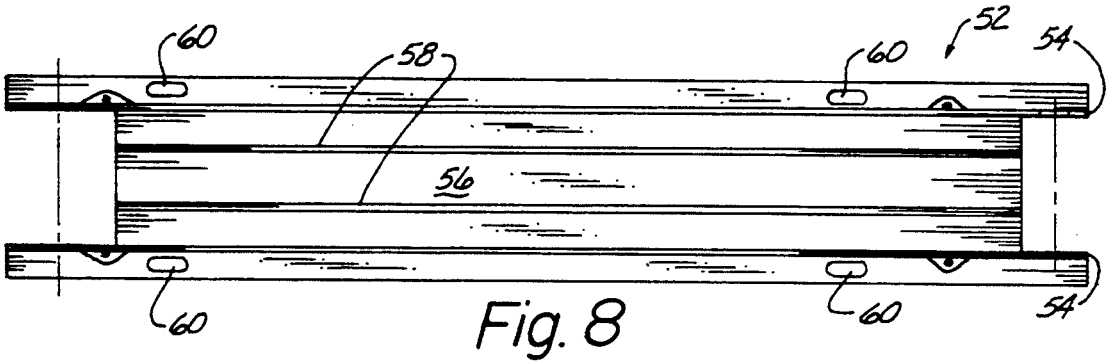
FIG. 8 is a top plan view of the frame of the conveyor.
Figure 9:
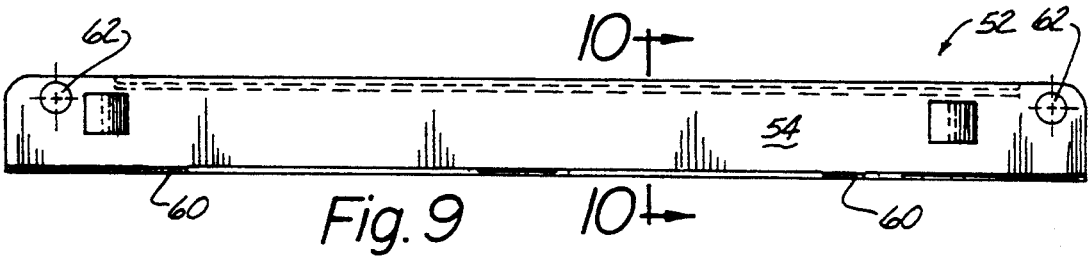
FIG. 9 is a side elevational view of the frame.
Figure 10:
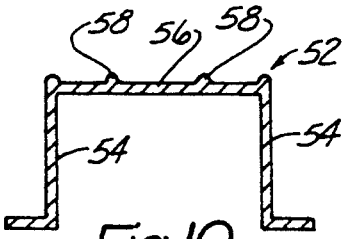
FIG. 10 is an enlarged sectional view taken along line 10—10 of FIG. 9.
Figure 11:
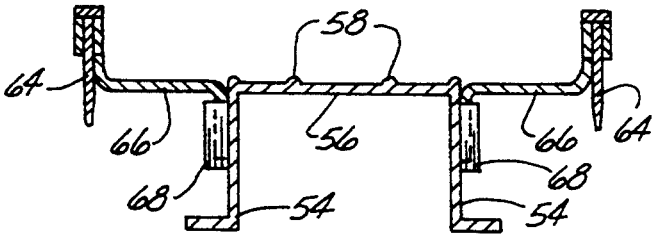
FIG. 11 is a view similar to FIG. 10 but in addition illustrating the laterally adjustable side rails attached to the frame.

As most clearly shown in FIGS. 2–4, a continuous belt (90) is trained over the drive pulley (70) and the idler pulley (80) such that the underside of the belt (90) rests on the longitudinal ridges (58) of the horizontal floor (56). The underside of the belt (90) includes timing projections (92) that are matingly received in the timing grooves (74 and 84) of the drive and idler pulleys (70 and 80). Dividers (94) extend out from the belt (90) to form product cavities (96)—each of the cavities being designed to receive one unit of product (98) to be selected by the user and dispensed from the vending machine. Each divider (94) includes a convex leading surface which enhances its rigidity when in the upright position while allowing the divider (94) to more easily fold back from the direction of the travel toward the belt surface where space is restricted. The belt (90) and the dividers (94) are formed of flexible transparent material, preferably a polyurethane elastomer, which may be extruded or injection molded as an integral unit.

Figure 12:
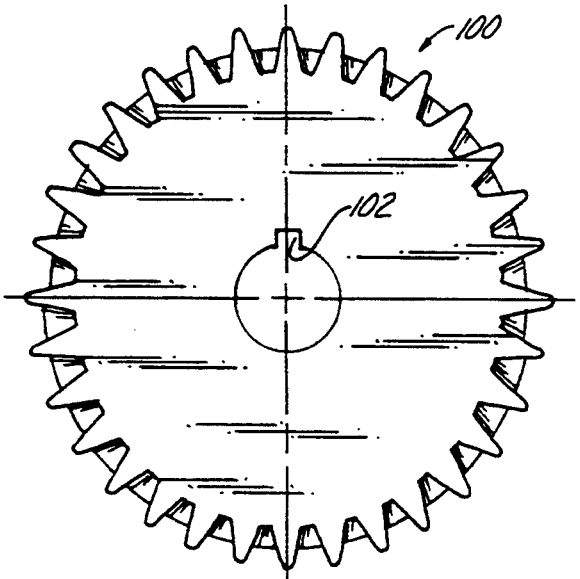
FIG. 12 is a front elevational view of the beveled drive gear that is attached to each of the several adapters used to connect the conveyor to the drive of existing vending machines.
Figure 13:
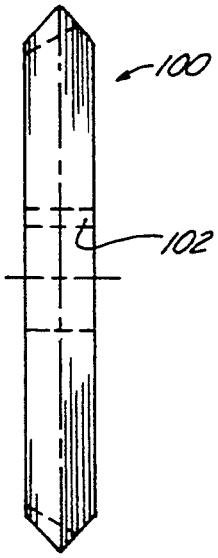
FIG. 13 is a side elevational view of the gear.
Figure 14:
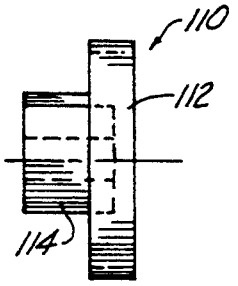
FIG. 14 is a side elevational view of an adapter used with vending machines manufactured by Automatic Products.
Figure 15:
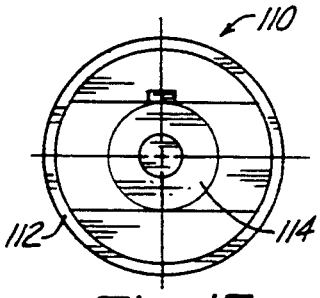
FIG. 15 is a front elevational view thereof.
Figure 16:
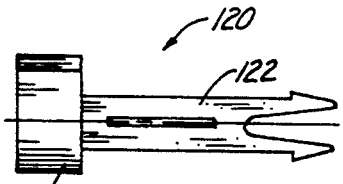
FIG. 16 is a side elevational view of our adapter used with late model vending machines manufactured by National Vendors.
Figure 17:
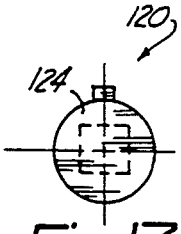
FIG. 17 is a front elevational view thereof.
Figure 18:
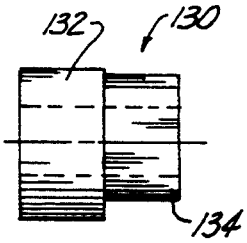
FIG. 18 is a side elevational view of an adapter used with vending machines manufactured by Rowe International.
Figure 19:
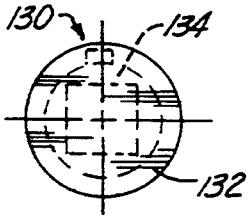
FIG. 19 is a front elevational view thereof.
Figure 20:
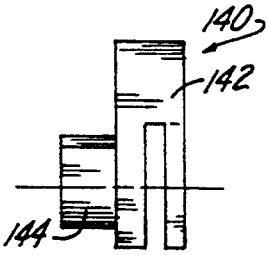
FIG. 20 is a side elevational view of an adapter used with early model vending machines manufactured by National Vendors.
Figure 21:
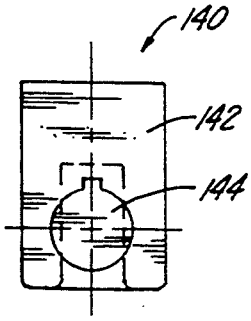
FIG. 21 is a front elevational view thereof.
Figure 22:
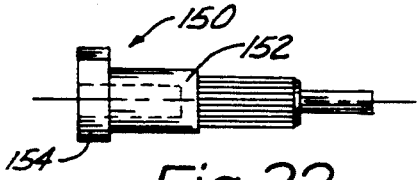
FIG. 22 is a side elevational view of an adapter used with vending machines manufactured by U-Select-It.
Figure 23:
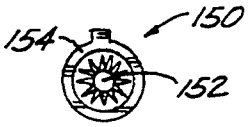
FIG. 23 is a front elevational view thereof.
Figure 24:
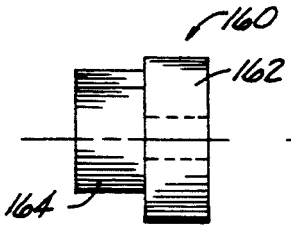
FIG. 24 is a side elevational view of an adapter used with vending machines manufactured by Polyvend.
Figure 25:
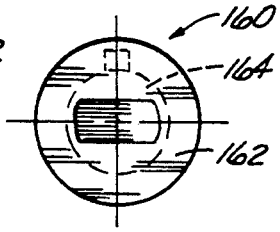
FIG. 25 is a front elevational view thereof.
Figure 26:
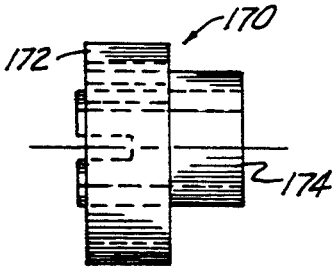
FIG. 26 is a side elevational view of an adapter used with vending machines manufactured by Electrovend.
Figure 27:
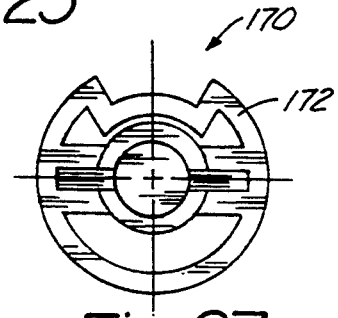
FIG. 27 is a front elevational view thereof.

FIGS. 12 and 13 show the beveled drive gear (100) that is attached to each of the several adapters (110, 120, 130, 140, 150, 160 and 170) used to operably connect the conveyor (50) to the drive unit (22) of existing vending machines (FIGS. 14–27). The drive gear (100) includes teeth that engage and drive the teeth of the gear (72) on the drive pulley (70) and a central keyway (102). Each of the adapters (110, 120, 130, 140, 150, 160, and 170) includes a drive unit engaging end (112, 122, 132, 142, 152, 162 and 172) that is adapted to couple with the drive unit (22) of a specific vending machine, and a keyed shaft end (114, 124, 134, 144, 154, 164 and 174) that couples with the central keyway (102) of the drive gear (100).

The conveyor (50) of the present invention may be installed as original equipment or as an after-market replacement for a helical product dispenser (20). To replace a helical dispenser (20) with a conveyor (50), the tray which carries several individual shelves (18) is extended out from the cabinet as if it is in the product loading position. The helical dispenser (20) is then removed by snapping it out of engagement with the drive unit (22). A suitable adapter, for example adapter (110) if a vending machine manufactured by Automatic Products is being modified, is attached to a drive gear (100) so that the keyed shaft (114) is inserted into the keyway (102) and secured by a suitable method such a gluing. The adapter (110) is then operably coupled to the drive unit (22) by snapping it into engagement with the drive unit (22). The conveyor (50) as depicted in FIG. 3 is then placed in position on the shelf (18) so that the teeth of the drive gear (100) mesh with the teeth of the gear (72) on the drive pulley (70). Fasteners are then inserted into slots (60) of the frame (52) and the conveyor (50) is secured in position on the shelf (18) as illustrated in FIGS. 1 and 2. Vendable products marketed in bowl-type containers can be clearly identified by the consumer by viewing the product (98) through the transparent front panel (16) and the transparent divider (94) before a selection is made.

Thus, it can be seen that at least all of the stated objects have been achieved.

Obviously, many modifications and variations of the present invention are possible in light of the above teachings. It is therefore to the understood that, within the scope of the appended claims, the invention may be practiced otherwise than as specifically described.

I claim:

1. In a vending machine having a cabinet including a transparent panel and a discharge chute for dispensing products from the machine, a number of product dispensers mounted in horizontal arrangement on shelves within the cabinet, each of the product dispensers having a discharge end being in communication with the discharge chute and being disposed adjacent the transparent panel, and a drive operably attached to each product dispenser, at least one of the product dispensers comprising:

a conveyor including a drive pulley operably attached to the drive, a continuous belt disposed about and driven by the drive pulley, dividers attached to and extending out from the belt and spaced along the belt at predetermined intervals forming a number of product cavities;

each of the dividers comprising a sheet of flexible transparent material, whereby a product disposed within the product cavity adjacent the transparent panel can be seen by the user through the transparent divider.

2. The product dispenser of claim 1 wherein the drive pulley includes a horizontally disposed axis and the belt is disposed such that the dividers extend up from the belt.

3. The product dispenser of claim 2 wherein the belt has an underside including timing projections and the drive pulley has an outer surface including timing grooves disposed to matingly receive the timing projections.

4. The product dispenser of claim 2 wherein the dividers have a convex leading surface.

5. The product dispenser of claim 1 wherein the dividers comprise a sheet of transparent polyurethane elastomer material.

6. The product dispenser of claim 5 wherein the belt comprises a loop of transparent polyurethane elastomer material.

7. The product dispenser of claim 6 wherein the belt and dividers are an integral transparent unit.

8. In a vending machine having a cabinet including a transparent panel and a discharge chute for dispensing products from the machine, a number of product dispensers mounted in horizontal arrangement on shelves within the cabinet, each of the product dispensers having a discharge end being in communication with the discharge chute and being disposed adjacent the transparent panel, and a drive operably attached to each product dispenser, at least one of the product dispensers comprising:

a conveyor including a drive pulley operably attached to the drive, a continuous belt disposed about and driven by the drive pulley, and dividers attached to and extending out from the belt and spaced along the belt at predetermined intervals forming a number of product cavities;

wherein the drive pulley includes a horizontally disposed axis and the belt is disposed such that the dividers extend up from the belt, wherein the belt has an underside including timing projections, and the drive pulley has an outer surface including timing grooves disposed to matingly receive the timing projections and wherein the conveyor further includes a U-shaped frame having spaced upstanding legs and a horizontal floor, the frame being secured to the shelf and disposed to rotatably receive the drive pulley at one end and an idler pulley at the opposite end, and wherein the floor includes longitudinal ridges disposed to engage the underside of the belt, whereby the contact area between the belt and the floor is minimized to reduce friction; and each of the dividers comprising a sheet of flexible transparent material, whereby a product disposed within the product cavity adjacent the transparent panel can be seen by the user through the transparent divider.

9. The product dispenser of claim 8 further including side rails attached to the frame and disposed to extend up from the floor spaced to the lateral sides thereof.

10. The product dispenser of claim 9 wherein the lateral spacing of the side rails is adjustable.

11. A method of modifying a vending machine having a cabinet including a transparent panel and a discharge chute for dispensing products from the machine, a number of helical product dispensers mounted in horizontal arrangement on shelves within the cabinet, each of the helical product dispensers having a discharge end being in communication with the discharge chute and being disposed adjacent the transparent panel, and a drive operably attached to each helical product dispenser, the method comprising the steps of:

removing at least one of the helical product dispensers from the machine;

attaching an adapter to the drive of the removed helical product dispenser;

replacing the removed helical product dispenser with a replacement product dispenser comprising:

a conveyor including a drive pulley operably attached to the drive, a continuous belt disposed about and driven by the drive pulley, and dividers attached to and extending out from the belt and spaced along the belt at predetermined intervals forming a number of product cavities; and each of the dividers comprising a sheet of flexible material whereby a product disposed within the product cavity adjacent the transparent panel can be seen by the user through the transparent divider.

12. The method of claim 11 wherein the drive pulley includes a horizontally disposed axis and the belt is disposed such that the dividers extend up from the belt.

13. The method of claim 12 wherein the belt has an underside including timing projections and the drive pulley has an outer surface including timing grooves disposed to matingly receive the timing projections.

14. The method of claim 12 wherein the dividers have a convex leading surface.

15. The method of claim 11 wherein the dividers comprise a sheet of transparent polyurethane elastomer material.

16. The method of claim 15 wherein the belt comprises a loop of transparent polyurethane elastomer material.

17. The method of claim 16 wherein the belt and dividers are and integral transparent unit.

18. A method of modifying a vending machine having a cabinet including a transparent panel and a discharge chute for dispensing products from the machine, a number of helical product dispensers mounted in horizontal arrangement on shelves within the cabinet, each of the helical product dispensers having a discharge end being in communication with the discharge chute and being disposed adjacent the transparent panel, and a drive operably attached to each helical product dispenser, the method comprising the steps of:

removing at least one of the helical product dispensers from the machine;

attaching an adapter to the drive of the removed helical product dispenser;

replacing the removed helical product dispenser with a replacement product dispenser comprising:

a conveyor including a drive pulley operably attached to the drive, a continuous belt disposed about and driven by the drive pulley, and dividers attached to and extending out from the belt and spaced along the belt at predetermined intervals forming a number of product cavities;

wherein the drive pulley includes a horizontally disposed axis and the belt is disposed such that the dividers extend up from the belt, wherein the belt has an underside including timing projections and the drive pulley has an outer surface including timing grooves disposed to matingly receive the timing projections; and wherein the conveyor further includes a U-shaped frame having spaced upstanding legs and a horizontal floor, the frame being secured to the shelf and disposed to rotatably receive the drive pulley at one end and an idler pulley at the opposite end, and wherein the floor includes longitudinal ridges disposed to engage the underside of the belt, whereby the contact area between the belt and the floor is minimized to reduce friction; and each of the dividers comprising a sheet of flexible transparent material whereby a product disposed within the product cavity adjacent the transparent panel can be seen by the user through the transparent divider.

19. The method of claim 18 further including side rails attached to the frame and disposed to extend up from the floor spaced to the lateral sides thereof.

20. The method of claim 19 wherein the lateral spacing of the side rails is adjustable.

* * * * *